US005802739A

United States Patent [19]

Potter et al.

[11] Patent Number: 5,802,739

[45] Date of Patent: Sep. 8, 1998

[54] COMPLEX-CONTOURED TENSILE BLADDER AND METHOD OF MAKING SAME

[75] Inventors: Daniel R. Potter, Forest Grove; Joel L. Passke, Portland; Michael A. Aveni, Lake Oswego, all of Oreg.

[73] Assignee: Nike, Inc., Beaverton, Oreg.

[21] Appl. No.: 475,500

[22] Filed: Jun. 7, 1995

[51] Int. Cl.[6] ..... A43B 13/20

[52] U.S. Cl. ..... 36/29; 5/452; 5/455; 5/457

[58] Field of Search ..... 36/29, 35 B, 153; 5/449, 450, 452, 455, 457

[56] References Cited

U.S. PATENT DOCUMENTS

| | | |
|---|---|---|
| 1,625,810 | 4/1927 | Krichbaum . |
| 1,916,483 | 7/1933 | Krichbaum . |
| 1,970,803 | 8/1934 | Johnson . |
| 2,269,342 | 1/1942 | Johnson . |
| 2,677,906 | 11/1954 | Reed . |
| 2,703,770 | 3/1955 | Melzer . |
| 2,748,401 | 6/1956 | Winstead . |
| 3,030,640 | 4/1962 | Gosman . |
| 3,048,514 | 8/1962 | Bentele et al. . |
| 3,284,264 | 11/1966 | O'Rourke . |
| 3,335,045 | 8/1967 | Post . |
| 3,366,525 | 1/1968 | Jackson . |
| 3,469,576 | 9/1969 | Smith et al. . |
| 4,167,795 | 9/1979 | Lambert, Jr. . |
| 4,292,702 | 10/1981 | Phillips . |
| 4,328,599 | 5/1982 | Mollura . |
| 4,483,030 | 11/1984 | Flick et al. . |
| 4,547,919 | 10/1985 | Wang . |
| 4,670,995 | 6/1987 | Huang . |
| 4,686,130 | 8/1987 | Kon . |
| 4,803,029 | 2/1989 | Iversen et al. . |
| 4,845,861 | 7/1989 | Moumdjian . |
| 4,874,640 | 10/1989 | Donzis . |
| 4,891,855 | 1/1990 | Cheng-Chung . |
| 4,906,502 | 3/1990 | Rudy . |
| 4,999,931 | 3/1991 | Vermeulen . |
| 5,022,109 | 6/1991 | Pekar . |
| 5,044,030 | 9/1991 | Balston . |
| 5,083,631 | 1/1992 | Rudy . |
| 5,104,477 | 4/1992 | Williams et al. . |
| 5,235,715 | 8/1993 | Donzis . |
| 5,245,766 | 9/1993 | Warren . |
| 5,337,492 | 8/1994 | Anderie et al. . |

FOREIGN PATENT DOCUMENTS

| | | |
|---|---|---|
| 727582 | 2/1966 | Canada . |
| 2 404 413 | 4/1979 | France . |
| 2 483 321 | 4/1981 | France . |
| 92 01 758.4 | 2/1992 | Germany . |
| 4 266 718 | 9/1992 | Japan . |
| WO 91/11931 | 8/1991 | WIPO . |
| WO 92/08384 | 5/1992 | WIPO . |

OTHER PUBLICATIONS

Sport Research Review, Nike, Inc. Jan./Feb. 1990.

*Primary Examiner*—Ted Kavanaugh
*Attorney, Agent, or Firm*—Banner & Witcoff, Ltd.

[57] ABSTRACT

A complex-contoured tensile bladder and method of making same in which a bladder comprises an envelope formed from two outer barrier layers surrounding a tensile element formed of two inner sheets. The inner sheets are attached to one another along selected first attachment portions and include die cuts at certain locations. Each of the outer barrier layers are attached to the inner sheet nearest it at selected second attachment portions which are incoincident with the selected first attachment portions. The outer layers are sealed around the periphery to form the envelope and the bladder is inflated with a gas so that the inner sheets form a tensile member which extends between the selected second portions, and the selected first portions form hinges disposed between the outer layers. When loaded the tensile member compresses at the hinges which readily allow for compression while not interfering with the cushioning properties of the gas. This construction of the bladder allows for the formation of complex-curved, contoured shapes by appropriately selecting the first attachment portions and the second attachment portions and the die cuts.

10 Claims, 12 Drawing Sheets

COMPLEX-CONTOURED TENSILE BLADDER AND METHOD OF MAKING SAME

FIELD OF THE INVENTION

The present invention relates to an improved cushioning member and method of making the same, and more particularly to a gas filled bladder having a tensile member which allows for the formation of complex-curved contours and shapes.

BACKGROUND OF THE INVENTION

Considerable work has been done to improve the construction of cushioning members which utilize gas filled bladders such as those used in shoe soles. Although with the recent developments in materials and manufacturing methods, gas filled bladder members have greatly improved in versatility, there remain problems associated with obtaining optimum performance and durability. Gas filled bladder members are commonly referred to as "air bladders", and the gas is commonly referred to as "air" without intending any limitation as to the actual gas composition used.

Five major engineering problems are associated with the design of air bladders formed of top and bottom barrier layers: (i) obtaining complex-curved, contoured shapes; (ii) obtaining the desired complex-curved, contoured shape without the formation of deep peaks and valleys in the cross section which require filling in or moderating with foams or plates; (iii) ensuring that the means employed to give the air bladder its complex-curved, contoured shape does not compromise the cushioning benefits of air; (iv) providing a reliable bond between tensile members and the outer barrier layers of the air bladder; and (v) reducing fatigue failure of the bladders caused by cyclic folding of portions of the bladder.

The prior art is replete with attempts to address these difficulties, but have only solved one, two or even three of the above-described problems often presenting new obstacles in the process. Most of the prior art discloses some type of tensile member. A tensile member is an element associated with the air bladder which ensures a fixed, resting relation between the top and bottom barrier layers when the air bladder is fully inflated, and which often acts as a restraining means to maintain the general form of the air bladder.

Some prior art constructions are composite structures of air bladders containing foam or fabric tensile members.

One type of such composite construction prior art concerns air bladders employing an open-celled foam core as disclosed in U.S. Pat. Nos. 4,874,640 and 5,235,715 to Donzis. These cushioning elements do provide latitude in their design in that the open-celled foam cores allow for complex-curved and contoured shapes of the bladder without deep peaks and valleys. However, bladders with foam core tensile member have the disadvantage of unreliable bonding of the core to the barrier layers. FIGS. 1 and 2 illustrate a cross section of a prior art bladder 10 employing an open-celled foam core 12 as a tensile member. FIG. 2 illustrates the loaded condition of bladder 10 with load arrows 14. As seen in FIG. 2, one of the main disadvantages of bladder 10 is that foam core 12 gives the bladder its shape and thus must necessarily function as a cushioning member which detracts from the superior cushioning properties of air alone. The reason for this is that in order to withstand the high inflation pressures associated with air bladders, the foam core must be of a high strength which requires the use of a higher density foam. The higher the density of the foam, the less the amount of available air space in the air bladder. Consequently, the reduction in the amount of air in the bladder decreases the benefits of cushioning.

Even if a lower density foam is used, a significant amount of available air space is sacrificed which means that the deflection height of the bladder is reduced due to the presence of the foam, thus accelerating the effect of "bottoming out." Bottoming out refers to the premature failure of a cushioning device to adequately decelerate an impact load. Most cushioning devices used in footwear are non-linear compression based systems, increasing in stiffness as they are loaded. Bottoming out is the point where the cushioning system is unable to compress any further. Compression set refers to the permanent compression of foam after repeated loads which greatly diminishes its cushioning aspects. In foam core bladders, compression set occurs due to the internal breakdown of cell walls under heavy cyclic compression loads such as walking or running. The walls of individual cells constituting the foam structure abrade and tear as they move against one another and fail. The breakdown of the foam exposes the wearer to greater shock forces, and in the extreme, to formation of an aneurysm or bump in the bladder under the foot of the wearer which will cause pain to the wearer.

Another type of composite construction prior art concerns air bladders which employ three dimensional fabric as tensile members such as those disclosed in U.S. Pat. Nos. 4,906,502 and 5,083,361 to Rudy. The bladders described in the Rudy patents have enjoyed considerable commercial success in NIKE, Inc. brand footwear under the name Tensile-Air®. Bladders using fabric tensile members virtually eliminate deep peaks and valleys, and the methods described in the Rudy patents have proven to provide an excellent bond between the tensile fibers and barrier layers. In addition, the individual tensile fibers are small and deflect easily under load so that the fabric does not interfere with the cushioning properties of air.

One shortcoming of these bladders is that currently there is no known manufacturing method for making complex-curved, contoured shaped bladders using these fabric fiber tensile members. The bladders may have different levels, but the top and bottom surfaces remain flat with no contours and curves. FIGS. 3 and 4 illustrate a cross section of a prior art bladder 20 employing a three dimensional fabric 22 as a tensile member. FIG. 4 illustrates the loaded condition of bladder 20 with load arrows 24. As can been seen in FIGS. 3 and 4, the surfaces of bladder 20 are flat with no contours or slopes.

Another disadvantage is the possibility of bottoming out. Although the fabric fibers easily deflect under load and are individually quite small, the sheer number of them necessary to maintain the shape of the bladder means that under high loads, a significant amount of the total deflection capability of the air bladder is reduced by the volume of fibers inside the bladder and the bladder can bottom out.

The main problem experienced with the fabric fibers is that these bladders are initially stiffer during loading than conventional air bladders. This results in a firmer feel at low impact loads and a stiffer "point of purchase" feel than belies their actual cushioning ability. The reason for this is because the fabric fibers have a relatively low elongation to properly hold the shape of the bladder in tension, so that the cumulative effect of thousands of these relatively inelastic fibers is to cause a type of "drum-head" effect. The "drum-head" tension of the outer surface caused by the low elongation or inelastic properties of the tensile member results in initial greater stiffness in the air bladder until the tension in the fibers is broken and the solitary effect of the air in the bladder can come into play which can affect the point of purchase feel of footwear incorporating bladder 20. The Peak G curve, Peak G v. time in milliseconds, shown in FIG. 5 reflects the response of bladder 20 to an impact. The portion of the curve labeled 26 corresponds to the initial stiffness of the bladder due to the fibers under tension, and the point labeled 28 indicates the transition point in which the tension in the fibers of fabric 22 are "broken" and give way to more of the cushioning effects of the air. The area of the curve labeled 30 corresponds to loads which are cushioned with more compliant air. The Peak G curve is a plot generated by an impact test such as those described in the *Sport Research Review, Physical Tests*, published by NIKE, Inc. as a special advertising section, January/February 1990, the contents of which is hereby incorporated by reference.

Another category of prior art concerns air bladders which are injection molded, blow-molded or vacuum-molded such as those disclosed in U.S. Pat. No. 4,670,995 to Huang and U.S. Pat. No. 4,845,861 to Moumdjian. These manufacturing techniques can produce bladders of any desired contour and shape while virtually eliminating deep peaks and valleys. The main drawback of these air bladders is in the formation of vertically aligned columns of elastomeric material which form interior tensile members and interfere with the cushioning benefits of the air. FIGS. 6 and 7 illustrate cross sections of a prior art bladder 40 which is made by injection molding, blow-molding or vacuum-forming in which vertical columns 42 act as tensile members. FIG. 7 illustrates bladder 40 in the loaded condition with load arrows 44. Since these interior tensile members are formed or molded in the vertical position, there is significant resistance to compression upon loading which can severely mask the cushioning properties of the air. Columns 42 are also prone to fatigue failure due to compression loads which force the columns to buckle and fold. Under cyclic compression loads the buckling can lead to fatigue failure of the columns.

Yet another prior art category concerns bladders using a corrugated middle film as a tensile member as disclosed in U.S. Pat. No. 2,677,906 to Reed which describes top and bottom sheets connected by a corrugated third sheet placed between them. The top and bottom sheets are heat sealed around the perimeter and at selected portions of the middle third sheet. A contoured insole is thus produced, however, because only a single middle sheet is used, the contours obtained must be uniform across the width of the insole. Only the height of the insole from front to back may be controlled and no complex-curved, contoured shapes are possible. Another disadvantage of Reed is that because the third, middle sheet is a continuous sheet, all the various chambers are independent of one another and must be inflated individually which is impractical for mass production.

The alternative embodiment disclosed in the Reed patent uses just two sheets with the top sheet folded upon itself and attached to the bottom sheet at selected locations to provide rib portions and parallel pockets. The main disadvantage of this construction is that the ribs are vertically oriented and similar to the columns described in the patents to Huang and Moumdjian, would resist compression and interfere with and decrease the cushioning benefits of air. As with the first embodiment of Reed, each parallel pocket thus formed must be separately inflated.

There exists a need for an air bladder with a suitable tensile member which solves all of the problems listed above: complex-curved, contoured shapes; elimination of deep peaks and valleys; no interference with the cushioning benefits of air alone; and the provision of a reliable bond between tensile member and outer barrier layers. As discussed above, while the prior art has been successful in addressing some of these problems, they each have their disadvantages and fall short of a complete solution.

SUMMARY OF THE INVENTION

The present invention pertains to an air bladder and method of making the same. The tensile bladder of the present invention may be incorporated into a sole assembly of a shoe to provide cushioning when pressurized. The bladder and method of the present invention allows for complex-curved, contoured shapes with no deep peaks and valleys, which does not interfere with the cushioning properties of air, and which provides a reliable bond between the tensile member and the outer barrier layers. Complex-contoured shape refers to varying the shape of the bladder with respect to more than one direction. The present invention overcomes the enumerated problems with the prior art while avoiding the design trade-offs associated with the prior art attempts.

In accordance with one aspect of the present invention, an air bladder is comprised of four sheets of barrier film in generally aligned relation to one another. To make the bladder, two inner sheets are combined to form the tensile member, and are surrounded by two outer sheets which form the outer barrier layers. The inner sheets are attached to one another along selected first attachment portions and include die cuts at certain locations. Each of the outer barrier layers are attached to the inner sheet nearest it at selected second attachment portions which are incoincident with the selected first attachment portions. The outer layers are then sealed around the periphery and the bladder is inflated with a gas so that the inner sheets form a tensile member which extends between the selected second portions and the selected first portions to form hinges disposed between the outer layers. When loaded, the hinges allow the tensile member to compress while not interfering with the cushioning properties of the gas. Because of the presence of these hinges which allow the tensile member to collapse readily under compression, the problem of fatigue failure of vertical columns in prior art bladders is solved. This construction of the bladder allows for the formation of complex-curved, contoured shapes by appropriately selecting the first attachment portions and the second attachment portions and the die cuts.

In another aspect of the present invention, the bladder is made by using pre-formed tensile members which are made by injection molding, blow-molding, extrusion or vacuum-forming and then placed between outer barrier layers. These pre-formed tensile members are generally in the configuration of the tensile members created by the inner sheets in the previously described method, but since they are pre-formed, they resemble collapsible truss-works to be surrounded by the bladder. It is important that the pre-formed tensile members have hinges provided in them that allow the tensile members of the bladder to freely flex in the loaded condition which eliminates fatigue stress on the members and avoids interfering with the cushioning properties of the gas.

In yet another aspect of the present invention, a single interior sheet comprises a tensile member which is selectively die cut and attached to the outer layers at selected points which generally alternate between the two outer layers.

The present invention provides a bladder and tensile member and method of making same which allows production of complex-curved, contoured shapes without deep peaks and valleys, which facilitates utilization of the cushioning properties of air, and which provides a reliable bond between the tensile member and the outer barrier layers of the bladder. The tensile member resembles a collapsible truss-work and is formed with natural hinges which are biased to compression, i.e. compressible or collapsible, so that upon loading the tensile member readily compresses or collapses at the hinges so as not to interfere with the cushioning effects of the air. The reason for this is that in making the bladder and tensile member, the tensile member is attached in a flat state which would be its shape under maximum compression load to the bladder. Therefore, the tensile member is in its least stressed condition when the bladder is fully compressed. This configuration ensures that the tensile member will not compromise the cushioning properties of air as it will tend to readily move to its least stressed state, i.e. bent at the hinges and flat, when the bladder is compressed.

These and other features and advantages of the invention may be more completely understood from the following detailed description of the preferred embodiment of the invention with reference to the accompanying drawings.

DETAILED DESCRIPTION OF THE PREFERRED EMBODIMENTS

Figure 1:
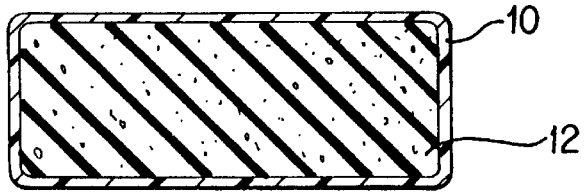
FIG. 1 PRIOR ART
FIG. 1 is a cross section of a prior art bladder using an open-celled foam core as a tensile member.
Figure 2:
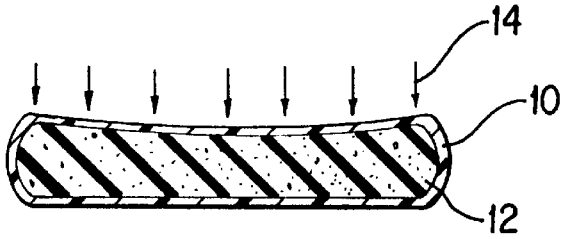
FIG. 2 PRIOR ART
FIG. 2 is a cross section of the prior art bladder of FIG. 1 shown in the loaded condition.
Figure 3:
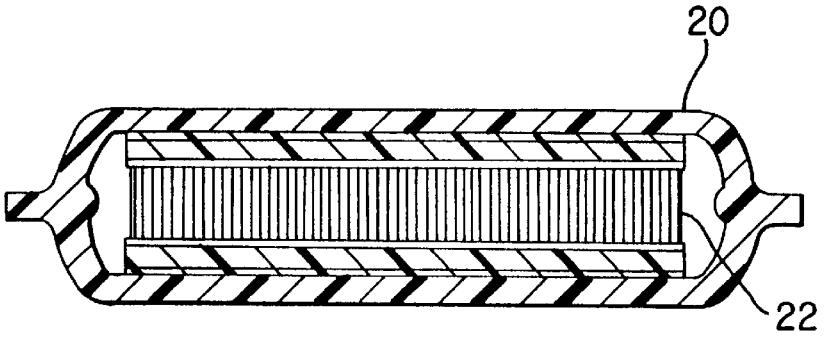
FIG. 3 PRIOR ART
FIG. 3 is a cross section of a prior art bladder using fabric fibers as tensile members.
Figure 4:
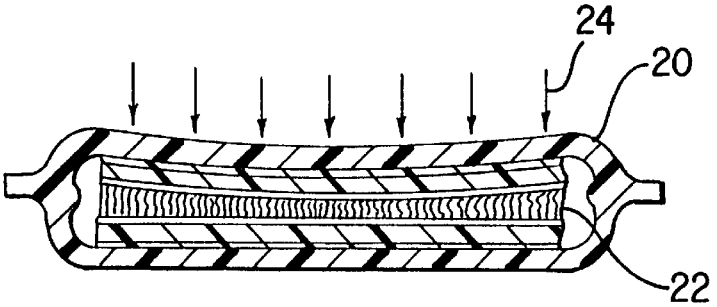
FIG. 4 PRIOR ART
FIG. 4 is a cross section of the prior art bladder of FIG. 3 shown in the loaded condition.
Figure 5:
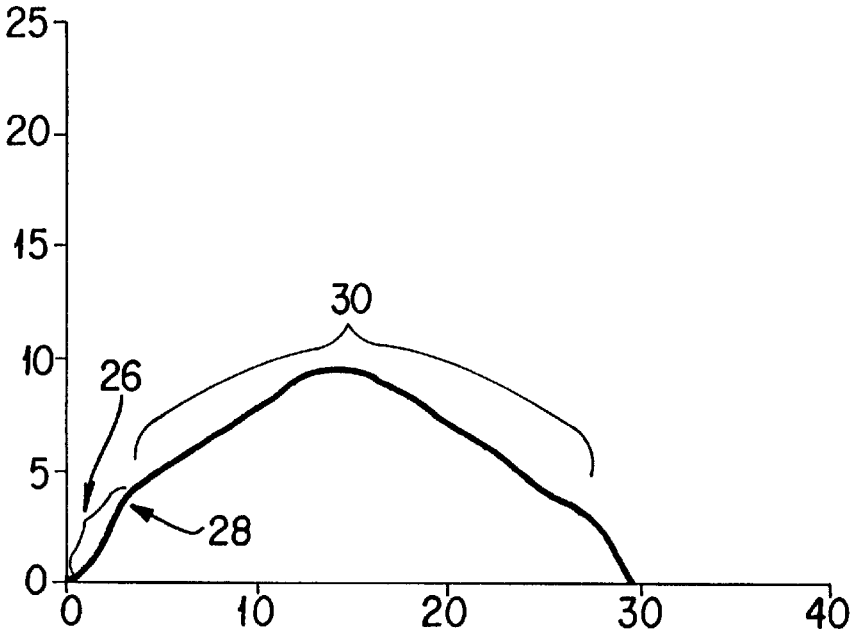
FIG. 5 PRIOR ART
FIG. 5 is a Peak G response curve of the prior art bladder of FIG. 3.
Figure 6:
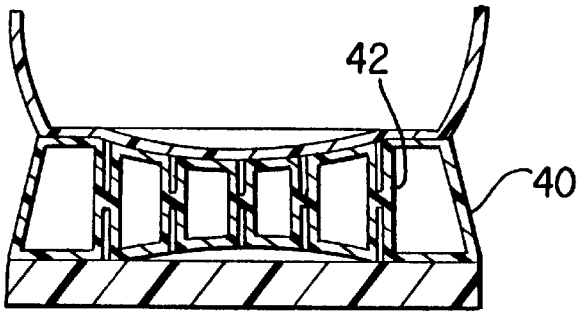
FIG. 6 PRIOR ART
FIG. 6 is a cross section of a prior art bladder using vertical columns as tensile members formed by injection molding, blow-molding or vacuum-forming.
Figure 7:
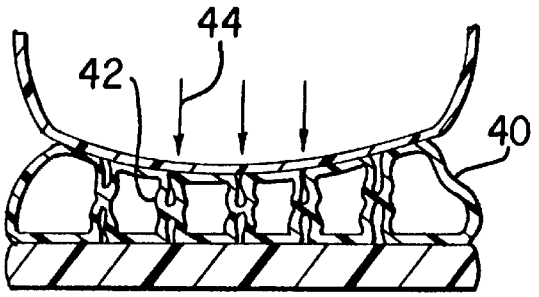
FIG. 7 PRIOR ART
FIG. 7 is a cross section of the prior art bladder of FIG. 6 shown in the loaded condition.
Figure 8:
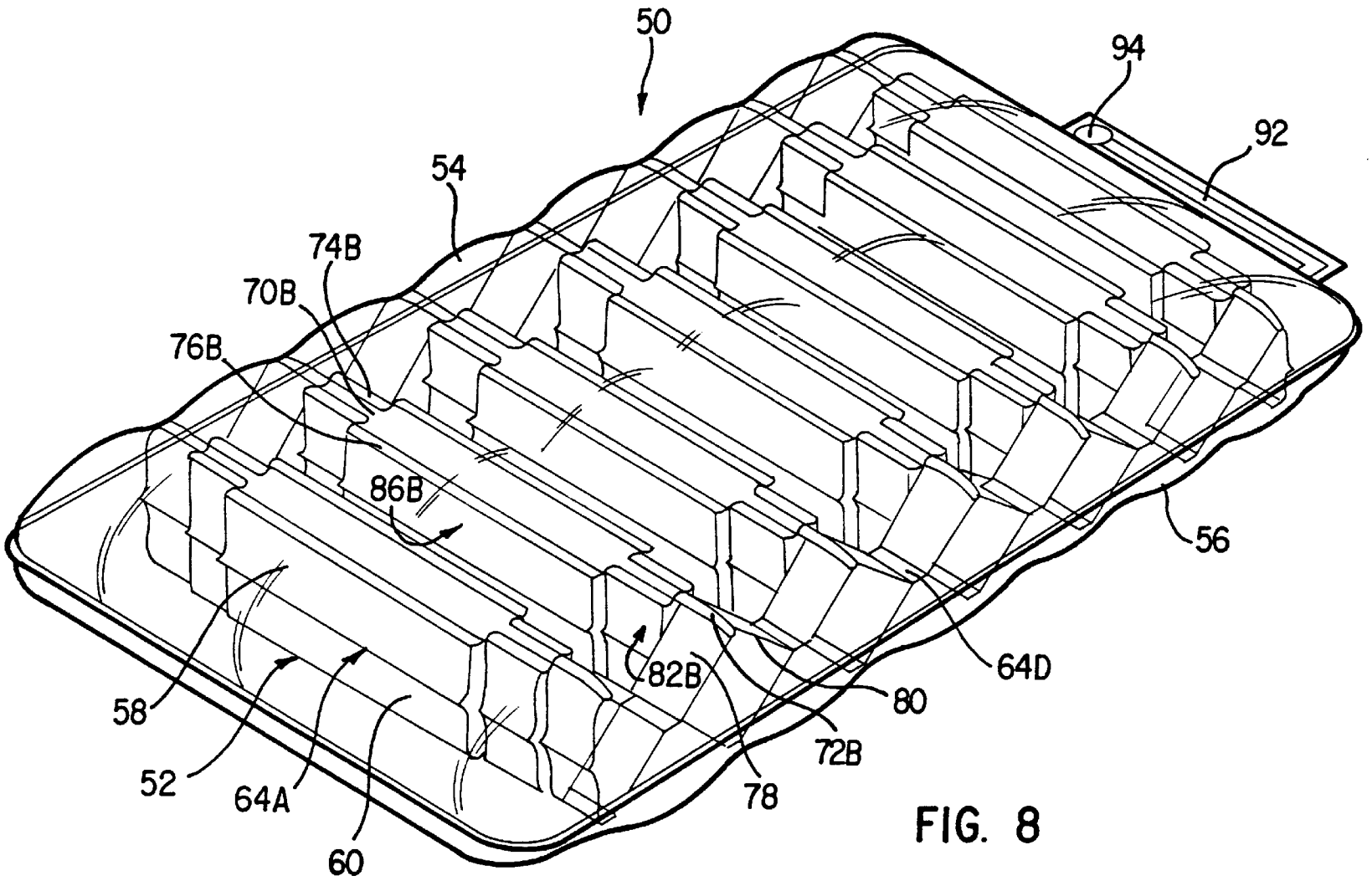
FIG. 8 is a perspective view of a complex-curved, contoured bladder and tensile member in accordance with a first preferred embodiment of the present invention.

Referring now to FIG. 8–13, a first preferred embodiment of the present invention will be described with reference to a complex-contoured tensile bladder 50 which contains a tensile element 52. Broadly, bladder 50 is a contoured envelope comprising outer barrier layers 54 and 56 which will be referred to for ease of explanation as top outer layer or top barrier 54 and bottom outer layer or bottom barrier 56. Within the envelope, two inner sheets, top inner sheet 58 and bottom inner sheet 60, are combined to form tensile element 52 which functions as a framework for bladder 50 and lends the bladder its complex-contoured shape. Complex-contoured shape refers to varying the shape and thickness of the bladder with respect to more than one direction, for example with respect to both the transverse and longitudinal directions. All of the sheets 54, 56, 58 and 60 are preferably polyurethane film of 0.030 inch thickness.

Figure 10:
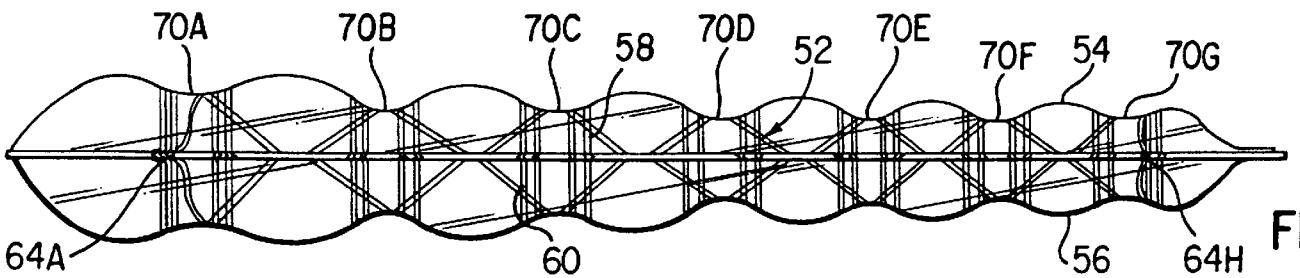
FIG. 10 is a side elevational view of the bladder of FIG. 8.

Tensile element 52 can be thought of as a collapsible truss-work which extends between and connects together the outer barrier layers of the bladder as seen in side view FIG. 10. All of the vertical and diagonal lines represent portions of tensile element 52 which, by their connection points, give bladder 50 its undulating contoured top and bottom surfaces. In this first preferred embodiment, tensile element 52 is formed from two flat sheets 58 and 60 which are welded together in a certain pattern and may be cut in certain areas to provide the desired configuration.

Figure 11:
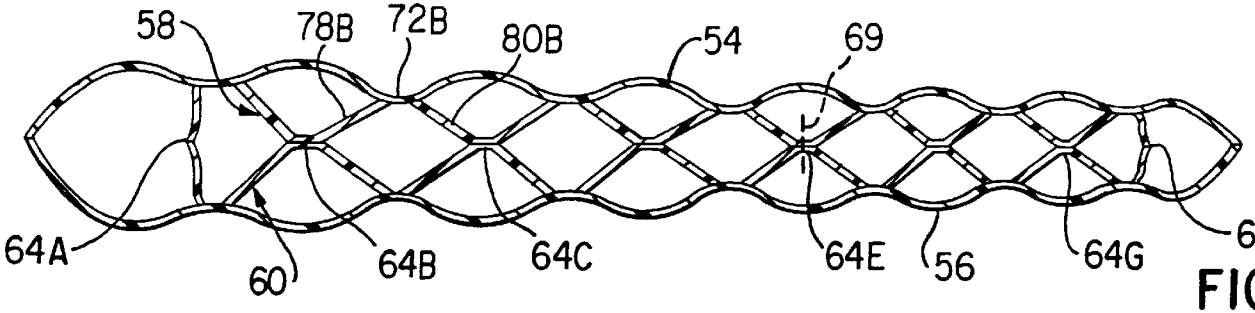
FIG. 11 is a cross section of the bladder taken along line 11—11 of FIG. 9.
Figure 12:
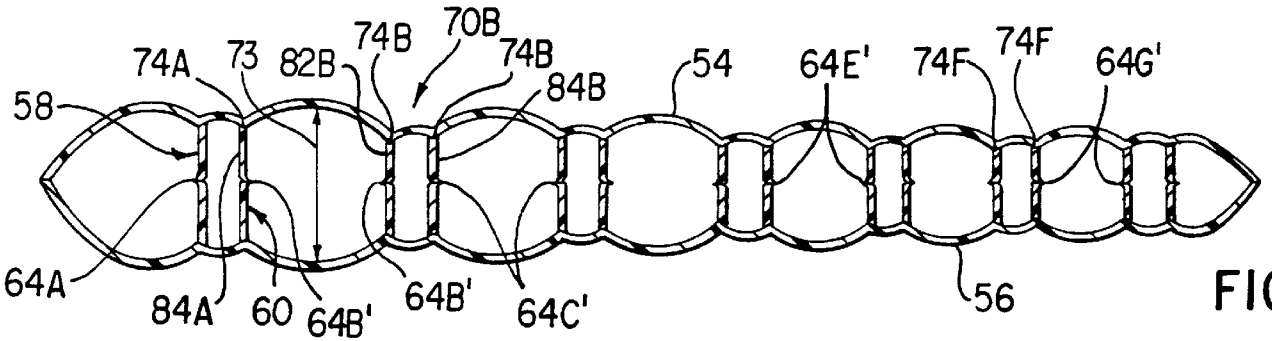
FIG. 12 is a cross section of the bladder taken along line 12—12 of FIG. 9.
Figure 13:
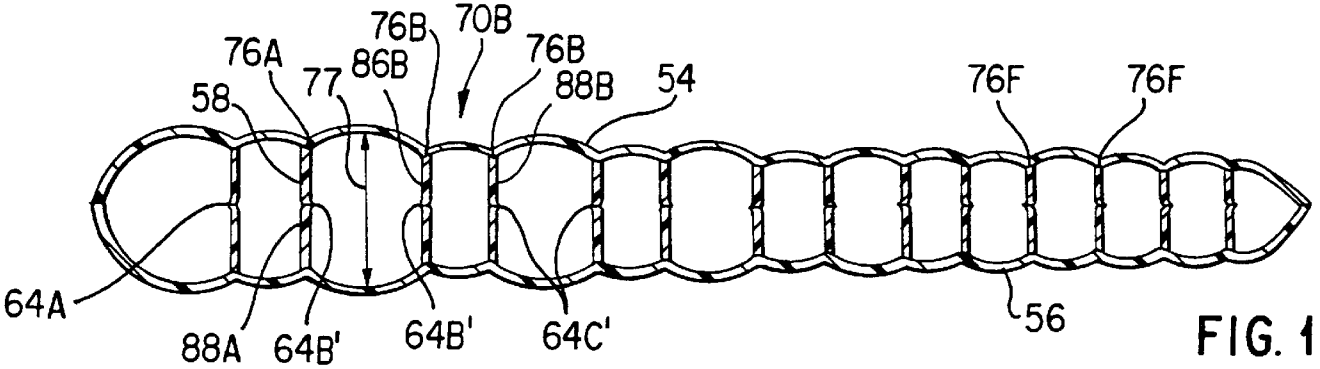
FIG. 13 is a cross section of the bladder taken along line 13—13 of FIG. 9.
Figure 14:
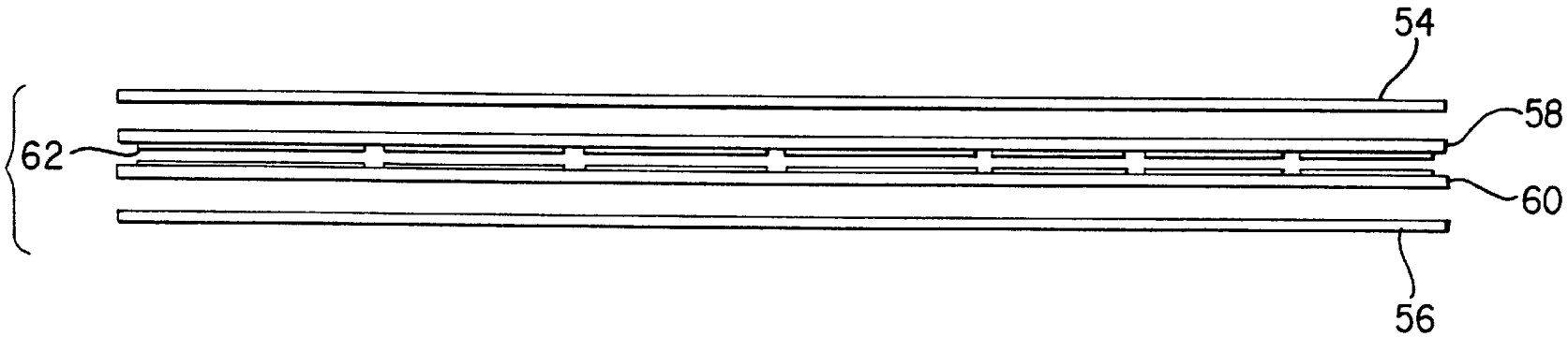
FIG. 14 is an exploded assembly view of the bladder of FIG. 8 shown in elevation.
Figure 15:
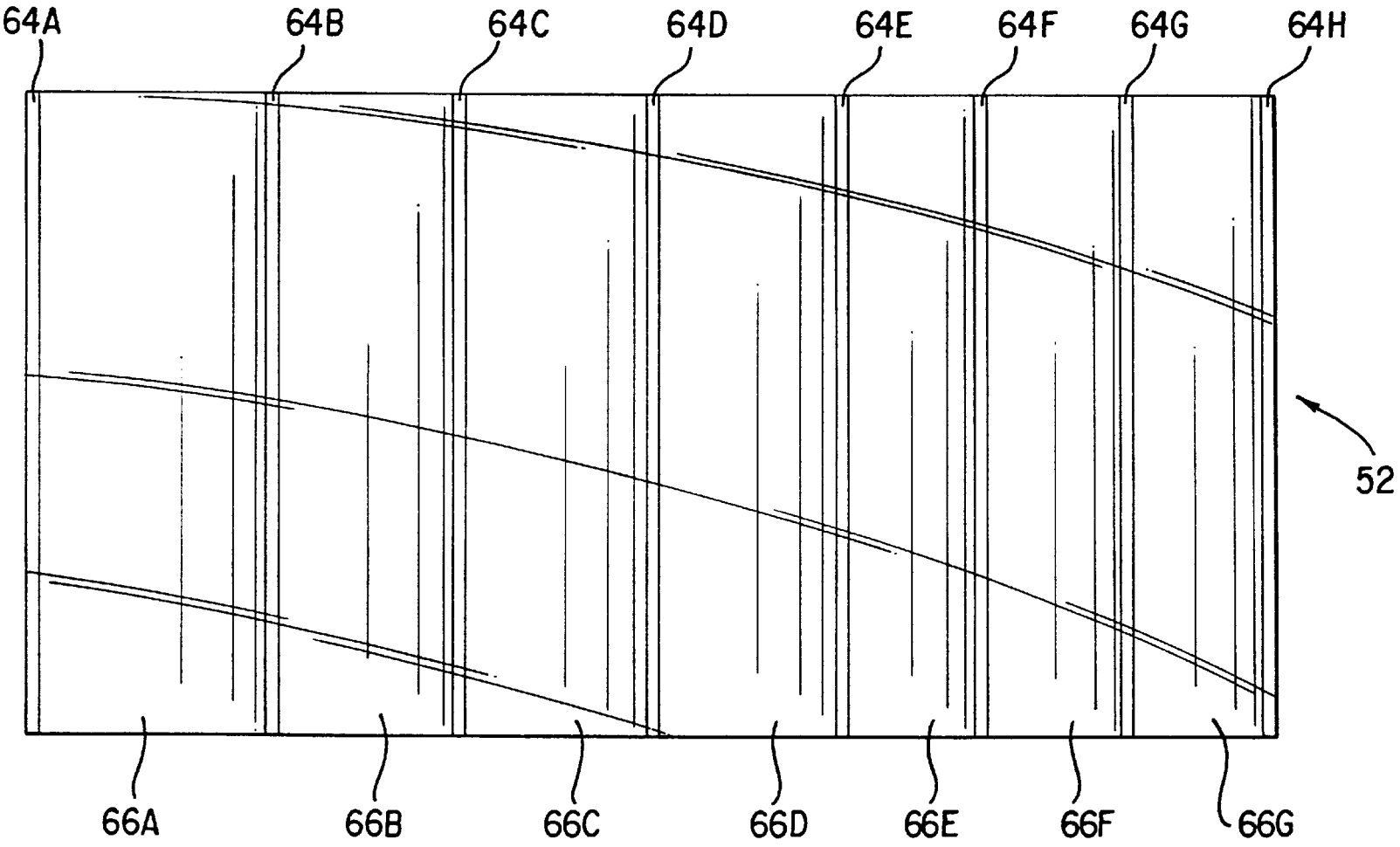
FIG. 15 is a top plan view of the inner sheets of the bladder of FIG. 8 showing first attachment points.
Figure 16:
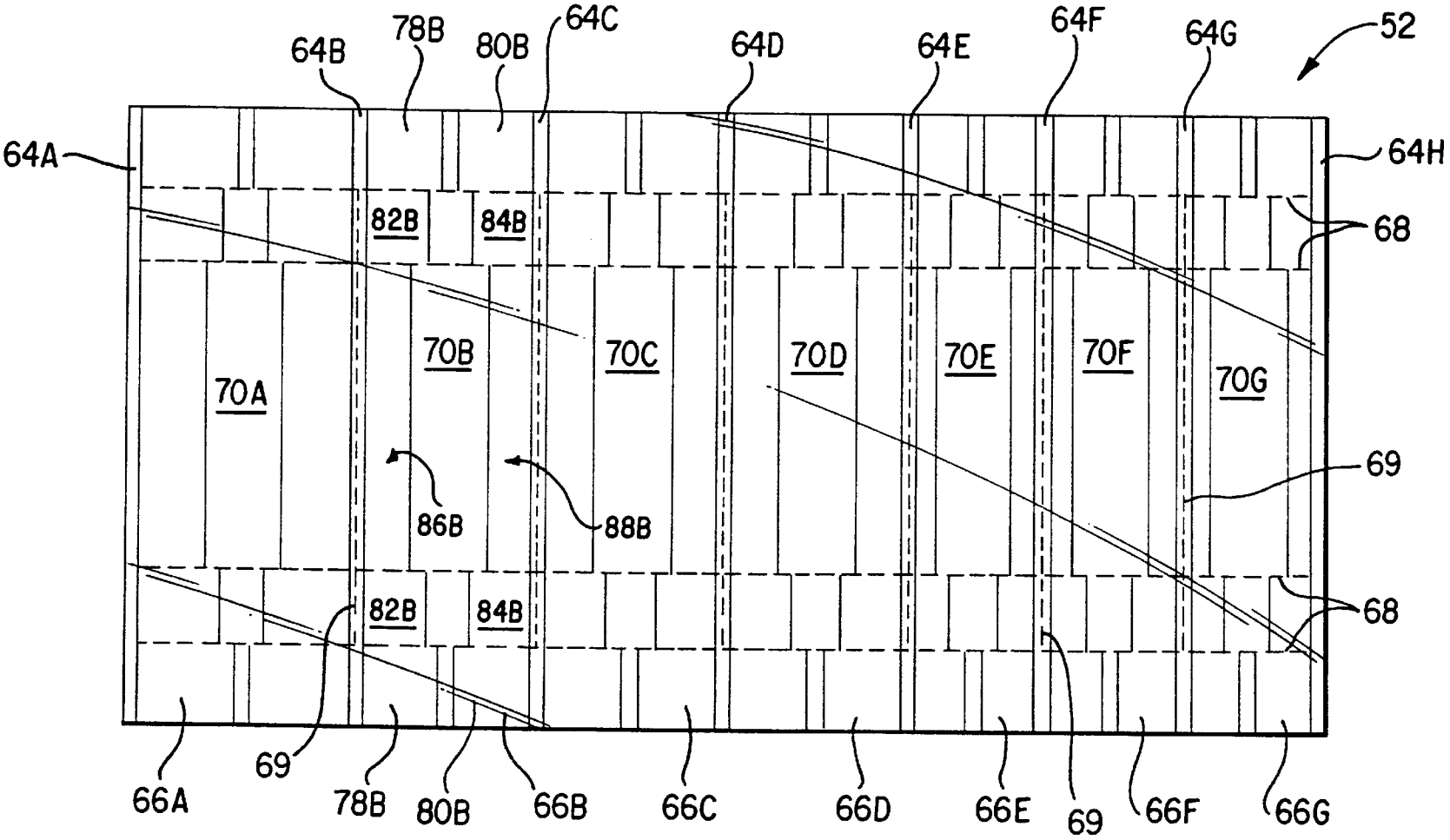
FIG. 16 is a top plan view of the inner sheets of FIG. 15 showing second attachment points and die cut lines.

The manufacturing steps for making bladder 50 are illustrated in FIGS. 14–16. In a first step, inner facing sides of inner sheets 58 and 60 are selectively treated with a weld prevention material 62 that prevents radio frequency welds from being formed. Examples of weld prevention materials are Teflon® coatings and Teflon® coated fabrics or strips which can positioned where necessary and then removed after welding. Inner sheets 58 and 60 are bonded together at eight welds or weld bars 64A through 64H which are formed widthwise in the areas where no weld prevention material is present. This effectively forms seven tubes 66A–66G linked by their commonly shared weld lines or bars 64B to 64G. The widths of tubes 66A–66g will determine the final bladder height at the center of each tube. Dashed lines 68 in FIG. 16 indicate positions of longitudinal cuts that are made through inner sheets 58 and 60 to achieve the illustrated tensile member. Dashed lines 69 indicate positions of splits made through the centers of welds 64B–64G so as to separate the tubes which shared the weld lines but leaving the tubes intact. Throughout the figures, when welds 64B–64G are split, the split portions are referred to as weld halves 64B', 64C', etc. FIGS. 11–13 best show whole and half welds. In FIG. 11, weld 64B is whole, but in FIGS. 12 and 13 which are cross sections at different points, numerals 64B' indicate the two halves of weld 64B which resulted when the weld was split. Splitting welds 64B–64G forms free standing tensile members in tensile element 52 as will be described.

Alternatively, if die cuts are eliminated, single tensile members would define the thickness of the bladder. As another alternative, the number of die cuts may be increased so that each parallel line of cuts defines further individual free standing tensile members. For bladders having complex contoured shapes, it is best to use die cuts to form numerous independent tensile members.

Weld lines 64A through 64H attaching inner sheets 58 and 60 can be referred to broadly as the selected first attachment points. FIG. 16 illustrates the preferred pattern of contour-forming bonding areas 70A through 70G which can be referred to broadly as the selected second attachment points, and which contain a configuration or pattern of weld lines. Contour-forming bonding areas 70A through 70G indicate those areas of inner sheets 58 and 60 which will be welded to outer layers 56 and 56, respectively. To attach tensile element 52 to the envelope, once inner sheets 58 and 60 have been welded to form tubes 66A–66G, sheets 58 and 60 are die cut along longitudinal lines 68 and width lines 69 which divide welds 64. Outer layers 54 and 56 are then put into position above and below welded and cut inner sheets 58 and 60 respectively. Prior to welding contour-forming bonding areas 70A through 70G, a weld prevention material is appropriately applied in the areas between welds 64A through 64H so that when bonding areas 70A to 70G are welded, the only bonds formed are those connecting outer layer 54 to inner sheet 58, and those connecting outer layer 56 to inner sheet 60. In this manner, inner sheets 58 and 60 form tensile element 52 which is disposed within the envelope of bladder 50 and attached thereto such that weld bars 64A through 64H are incoincident, or do not coincide, with the welds in bonding areas 70A through 70G. In other words, the selected first attachment points, 64A–64H, do not coincide with the selected second attachment points, the peripheries of 70A–70G, so that tensile element 52 functions as a framework that lends a 5 complex contoured shape to bladder 50 without detracting from the cushioning properties of air. The side view FIG. 10 and cross sectional views FIGS. 11–13 most clearly illustrate the framework configuration of tensile element 52.

In order to fully describe the relationship of tensile member 52 to bladder 50, reference is made to FIGS. 9–13, in which bonding area 70B is described in detail. It will be understood that the remaining bonding areas 70A and 70C–70G are of similar construction and the same reference numerals can be applied suffixed with the appropriate letter to indicate exact location.

Contour-forming bonding area 70B extends across the width of tensile member 52 within the confines of tube 66B formed between welds 64B and 64C. Bonding area 70B includes end welds 72B, side welds 74B and central welds 76B. The inner sheet portions on either side of end welds 72B are designated as end tensile members 78B and 80B. Similarly, the inner sheet portions on either side of side welds 74B are designated as side tensile members 82B and 84B. The inner sheet portions on either side of central welds 76B are designated as central tensile members 86B and 88B.

FIG. 16 illustrates the weld pattern for contour-forming bonding areas 70A–70G. Each such area is within the confines of its respective tube 66A–66G. Due to the configuration of the bonding areas and the cut lines 68 and 69, tensile element 52 of the completed bladder will include a plurality of tensile members as enumerated above.

Figure 9:
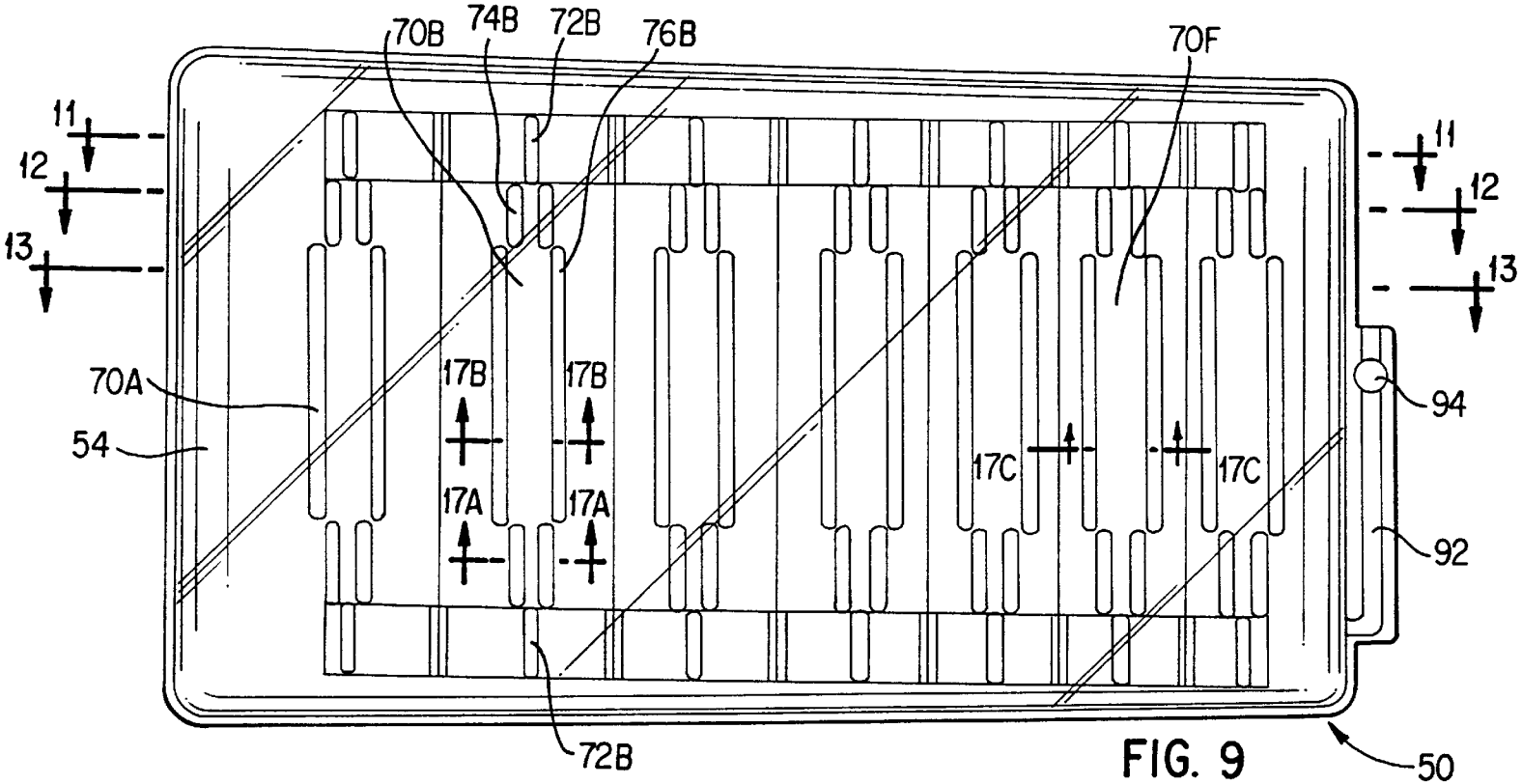
FIG. 9 is a top plan view of the bladder of FIG. 8.

Cross section FIG. 11 is taken through line 11—11 of FIG. 9 and illustrates end welds 72 and tube forming welds 64. As can be seen at this particular cross section, inner sheets 58 and 60 extend generally diagonally between outer layers 54 and 56. This is due to leaving tube forming weld 64 whole, that is, uncut.

Cross section FIG. 12 is taken through line 12—12 of FIG. 9 and illustrates side welds 74 between the envelope and tensile element. In addition, this particular cross section illustrates the vertical tensile members 82 and 84 which result from splitting tube forming welds 64 as described above. With particular reference to bonding area 70B, tensile member 82B is formed from top inner sheet 58 and bottom inner sheet 60 bonded together at half-weld 64B' which is a portion of weld 64B after being split. Half-weld 64B', as with all of the other welds which float within the envelope, forms a natural hinge member which serves as a compression or collapse point when the bladder is loaded in that region.

Cross section FIG. 13 is taken through line 13—13 of FIG. 9 and illustrates central welds 76 between the envelope and tensile element. Similar to the tensile members of FIG. 12, central tensile members 86 and 88 resulted from dividing tube forming welds 64. Again, with particular reference to bonding area 70B, tensile member 86B is formed from top inner sheet 58 and bottom inner sheet 60 bonded together at half-weld 64B' which is a portion of weld 64B after being split. Again, half-weld 64B' is a natural hinge member and compression point when the bladder is loaded.

Contrasting the contours of the envelope in FIGS. 12 and 13, it can seen that the contours near the center of bladder 50 as seen in FIG. 13 are generally more level and the contours in the region of the side welds as seen in FIG. 12 have more fluctuation. This is due to the spacing of the welds which connect the tensile element to the envelope: side welds 74 in FIG. 12 are spaced closer together than central welds 76 shown in FIG. 13. The greater the distance between the welds in one bonding area, the smoother and more level the contours.

As an illustration, in FIG. 12, the spacing between adjacent welds 74B and 74B also controls the spacing between adjacent welds 74A and 74B. Put more broadly, when the spacing between the side welds 74 is varied, that translates into a change in the spacing between adjacent bonding areas and a change in the thickness of the envelope. In FIG. 12, the thickness of the envelope between tensile members 84A and 82B is marked 73. In FIG. 13, the thickness between tensile members 88A and 86B is marked 77. Due to the larger spacing between central welds 76 as compared to side welds 74, thickness 77 is less than thickness 73. In other words, the greater spacing of central welds 76 decreases the length of outer barrier layer portions which bubble outward and therefore reduce the thickness 77 of the envelope. When the welds are spaced closer together like side welds 74, the length of the outer barrier portions which can bubble outward is increased thereby increasing the thickness 73 of the envelope. As can be seen from FIGS. 11–13, when the spacing between welds is increased, the contours are more level the contours, whereas when the spacing between welds is decreased, the contours fluctuate more.

Bladder 50 is configured for incorporation into a sole assembly of a shoe, and as such the top surface of the bladder is slightly cupped. This is illustrated in the cross sections of FIGS. 11 and 12 which are closer to the periphery of the bladder and are thicker than the cross section of FIG. 13 which is closer to the center of the bladder. This difference shows that the sides of the bladder have a greater contour and thickness.

The spacing and configuration of the various welds in each of the contour-forming bonding areas 70 may be determined to achieve any desired complex-contoured shape.

Figure 17A:
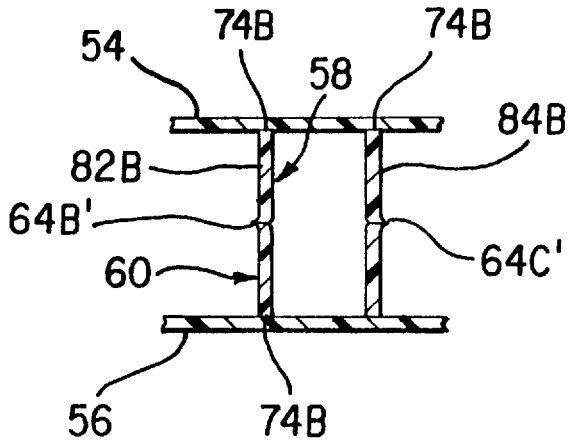
FIG. 17A is a cross section of the bladder taken along line 17A—17A of FIG. 9.
Figure 17B:
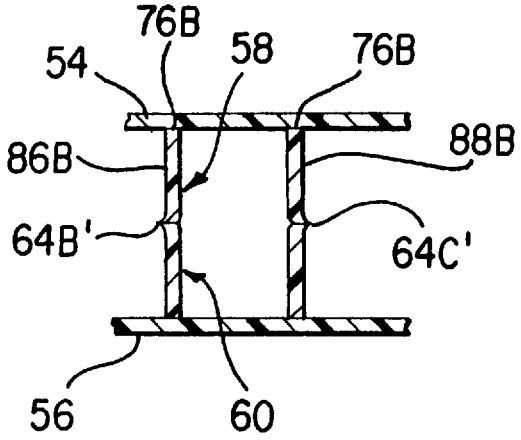
FIG. 17B is a cross section of the bladder taken along line 17B—17B of FIG. 9.
Figure 17C:
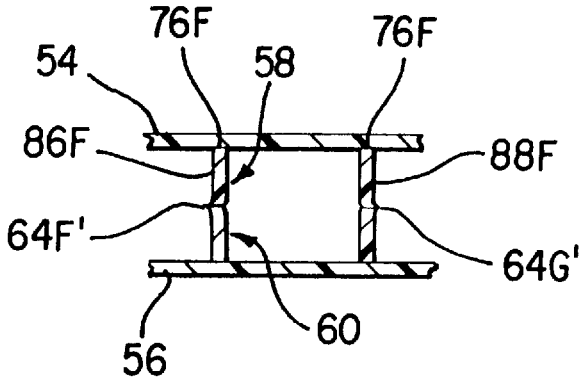
FIG. 17C is a cross section of the bladder taken along line 17C—17C of FIG. 9.

FIGS. 17A–17C further illustrate these principles. FIGS. 17A and 17B are cross sections of bonding area 70B and FIG. 17C is a cross section of bonding area 70F. FIGS. 17A and 17B are detailed views of the cross sections shown in FIGS. 12 and 13, and illustrate more clearly the hinges formed by half-welds 64B' and 64C'. The height of bladder 50 in these regions is determined by the distance between adjacent tube forming welds 64B and 64C. As seen in FIG. 16, welds 64B and 64C are spaced further apart than welds 64F and 64G which define bonding area 70F. This accounts for the difference in height between the cross sections of bladder 50 at area 70B and 70F, FIGS. 17B and 17C.

Tensile element 52 is bonded at selected second attachment points, meaning the contour forming bonding areas 70, to the respective outer barrier layers 54 and 56, and a peripheral seal 90 is formed along the edges of barrier layers 54 and 56. Bonding at the second attachment points and sealing the periphery may be done consecutively or simultaneously. At one end of bladder 50, an inflation conduit 92 leading to an inflation point 94 is provided through which bladder 50 is inflated. Inflation point 94 is sealed off once inflation is complete.

Each bonding area 70 can take on any desired shape within the confines of its corresponding tube 66. For example, in contour-forming bonding area 70B, welds 72B, 74B and 76B can be any desired width apart at any given location as long as they remain within the confines of welds 64B and 64C. A weld that extended entirely from weld 64B to 64C would give a final bladder height in that area of zero plus the film thickness. If the weld width in a area 70B were zero then the final bladder height in that area would approach the width between 64B and 64C plus the film thickness. By manipulating the spacing and number of tube forming welds 64 and the shape of contour-forming welds 72, 74 and 76, an endless variety of complex contour bladder shapes are possible.

Another aspect of bladder 50 is that welds 64 may be divided along a portion of each weld 64 which corresponds to side welds 74 and central welds 76 of welded area 70. These die cut lines are labeled 69 in the figures, and this cutting step would take place after the welds of bonding areas 70 are formed. Of course the cutting and welding could be done simultaneously with the appropriate equipment. One of the main advantages of bladder 50 is a consequence of its manufacturing method. Because tensile member 52 is formed from inner sheets 58 and 60 which are welded together along welds 64 in the flat position, that is, the position of full compression in a finished bladder, the highest stress on welds 64 in an inflated bladder comes in the unloaded condition. This is because welds 64 act as hinges between inner sheets 58 and 60 and allow the sheets to be completely compressed to their flattened position which is also their least stressed condition. Therefore, under a load, tensile member 52 readily compresses along hinges/welds 64 and does not at all interfere with the cushioning properties of the air.

Figure 18A:
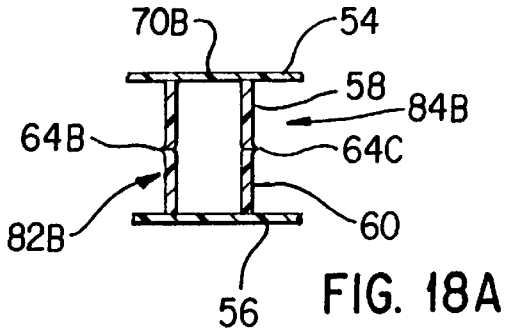
FIG. 18A is a schematic illustration of a bladder section similar to that of FIG. 17A shown in the unloaded condition.
Figure 18B:
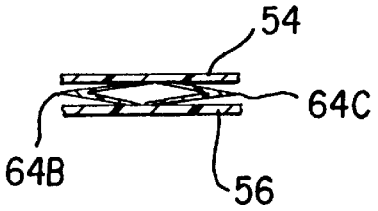
FIG. 18 is a schematic illustration of the bladder section of FIG. 18A shown in the loaded condition.

FIGS. 18A and 18B illustrate this phenomenon with respect to welded area 70B. In the unloaded condition, FIG. 18A, tensile members 82B and 84B and consequently hinges/welds 64B and 64C are at their maximum tension. In the loaded condition, FIG. 18B, tensile member 82B is compressed by operation of hinge 64B and tensile member 84B is compressed by operation of hinge 64C. Because of the manufacturing method, tensile members 82B and 84B are in their least stressed condition upon load thereby ensuring that the tensile element will not function as a load bearer and thus not detract from the cushioning properties of the air.

Figure 19:
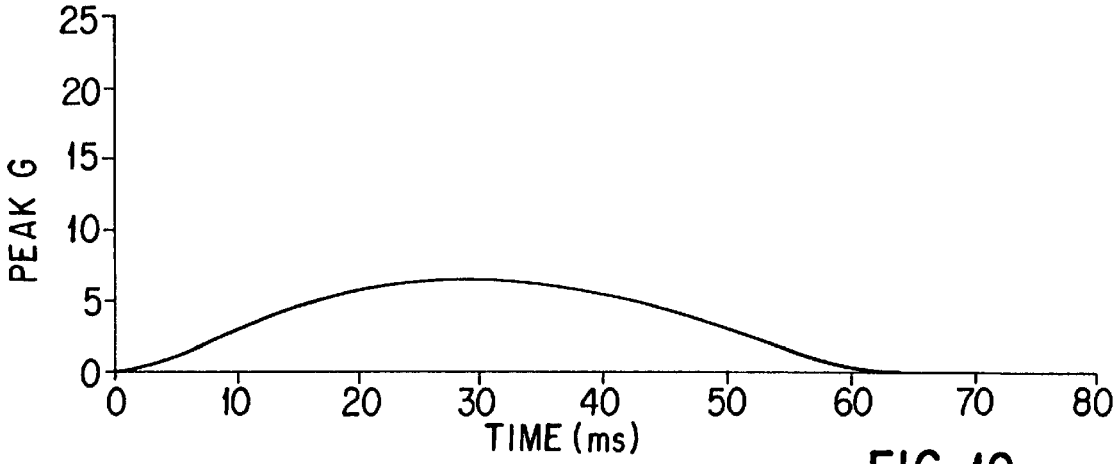
FIG. 19 is a Peak G response curve of the bladder of FIG. 8.

FIG. 19 illustrates a Peak G curve showing the smooth deceleration of impact of the preferred embodiment without bottoming out. Allowing free flexure at hinges/welds 64 of tensile element 52 ensures that the cushioning properties of air are not hampered.

This is in contrast to the prior art tensile members which were stressed, bent or wrinkled during compression causing prior art bladders to receive less than the full benefit of the cushioning properties of air. Additionally, if prior art tensile members bottomed out there was the possibility of additional damage to the connection points to the barrier layers.

In an alternative method of manufacture of the present invention, the resulting bladder is substantially identical to bladder 50, but instead of using four separate flat sheets, a tensile element is made separately by injection molding, blow-molding, extrusion or vacuum-forming so that it is a pre-formed component. In this alternative method, the pre-formed tensile element truly is a collapsible truss-work for insertion into an envelope. The pre-formed tensile element has substantially the same shape as the tensile element created by bonding the inner sheets together, and it is important that the pre-formed tensile element also have hinges that allow the individual tensile members to freely flex in the loaded condition. This eliminates stress on the members and avoids interfering with the cushioning properties of air in the bladder. A limitation of using a pre-formed tensile element is that the tensile element cannot be welded to the outer barrier layers in a flat position as easily as the previously described flat inner sheets. It is also more difficult to apply the weld prevention material in the center of the tensile element while making contour-forming welds with the outer barrier layers. Notwithstanding these limitations, pre-formed tensile elements may be used in some situations without experiencing much difficulty.

Figure 20:
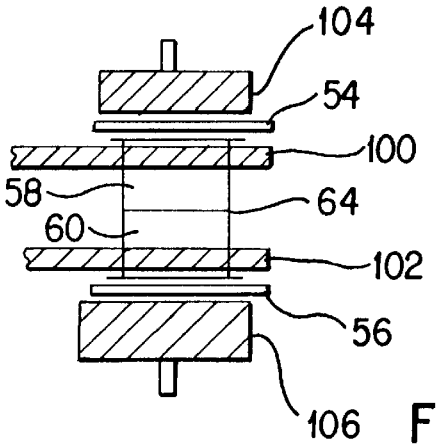
FIG. 20 is a detailed view of an alternative welding technique.

A weld technique which could be used which eliminates the need for a weld prevention material involves the use of metal weld bars as seen in FIG. 20. Metal weld bars or fingers 100 and 102 are placed inside tensile element 52 adjacent to the upper, inner surface and the lower, inner surface defined by inner sheets 58 and 60. Radio frequency weld dies 104 and 106 are placed above outer barrier layer 54 and below outer barrier layer 56, respectively. Welds can now be formed only between weld bar 100 and weld die 104, and between weld bar 102 and weld die 106, effectively bonding the tensile element to outer barrier layers 54 and 56. After the welds are formed, weld bars 100 and 102 are removed. The tensile element may be welded simultaneously at multiple locations using multiple pairs of weld bars. Any of the above-described techniques of bonding and welding may be used in combination to make complex-contoured tensile bladders in accordance with the present invention.

Figure 21:
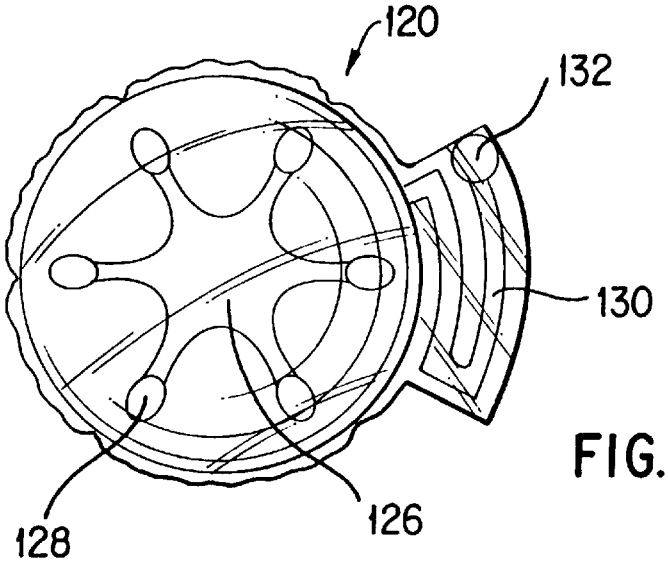
FIG. 21 is a top plan view of a complex-curved, contoured bladder and tensile member in accordance with a second preferred embodiment of the present invention.
Figure 22:
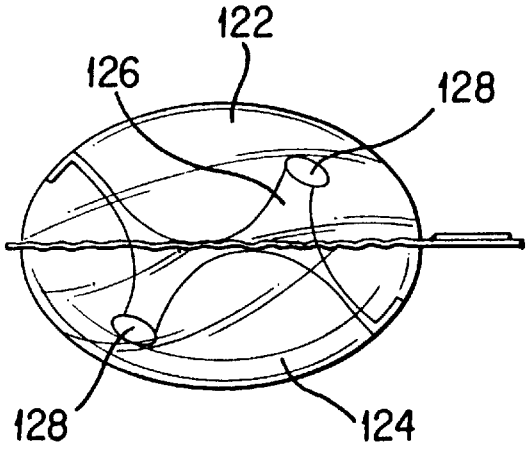
FIG. 22 is a side elevational view of the bladder of FIG. 21.
Figure 23:
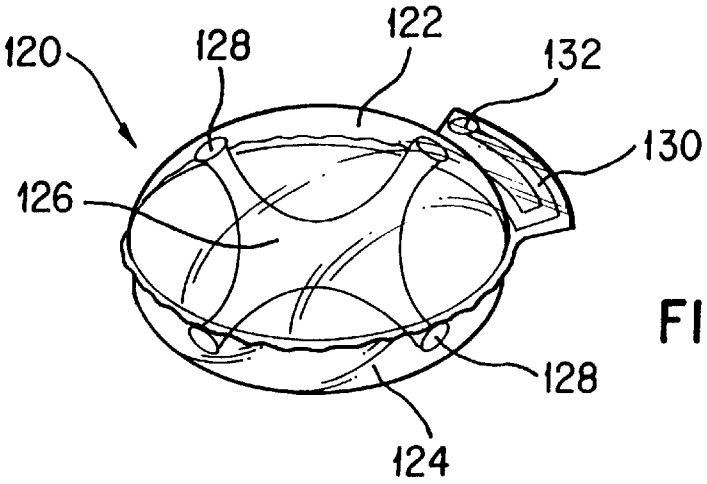
FIG. 23 is a perspective view of the bladder of FIG. 21.

A second preferred embodiment of the present invention is a complex-contoured tensile bladder employing a single interior sheet. Referring to FIGS. 21–23, an exemplary shape of bladder 120 is illustrated, but it will be understood that the principle of a single interior sheet tensile element can be applied to form a variety of shapes and contours. Broadly, a tensile element formed of a single sheet would be cut and then attached to the top and bottom outer layers in an alternating fashion so that when the bladder is pressurized, the tensile element extends therebetween.

Bladder 120 comprises an upper barrier layer 122 and a lower barrier layer 124 and a tensile element 126 disposed therein. Tensile element 126 comprises a single sheet of polyurethane film. To make bladder 120, tensile element 126 which is selectively die cut to the appropriate shape is placed between upper and lower barrier layers 122 and 124. Weld prevention material is selectively placed between the upper and lower barrier layers and the tensile element as desired, and the assembly is welded so that welds 128 are provided as shown. Upper and lower barrier layers 122 and 124 are then welded together around their periphery to seal bladder 120, and an inflation conduit 130 leading to an inflation point 132 are provided. Bladder 120 is then inflated through inflation point 132, after which inflation point is sealed. Similar to the first preferred embodiment, tensile element 126 is welded to the barrier layers which make up the envelope of bladder 120 when the films are in a flattened state so that the compressed or loaded condition of bladder 120 corresponds to the least stressed state of tensile element 126. Thus, tensile element 126 does not hamper the cushioning properties of the air when the inflated bladder is compressed. By selectively die cutting the interior sheet and selectively placing weld prevention materials alternately adjacent the upper and lower barrier layers, a variety of bladder shapes may be obtained.

Figure 24:
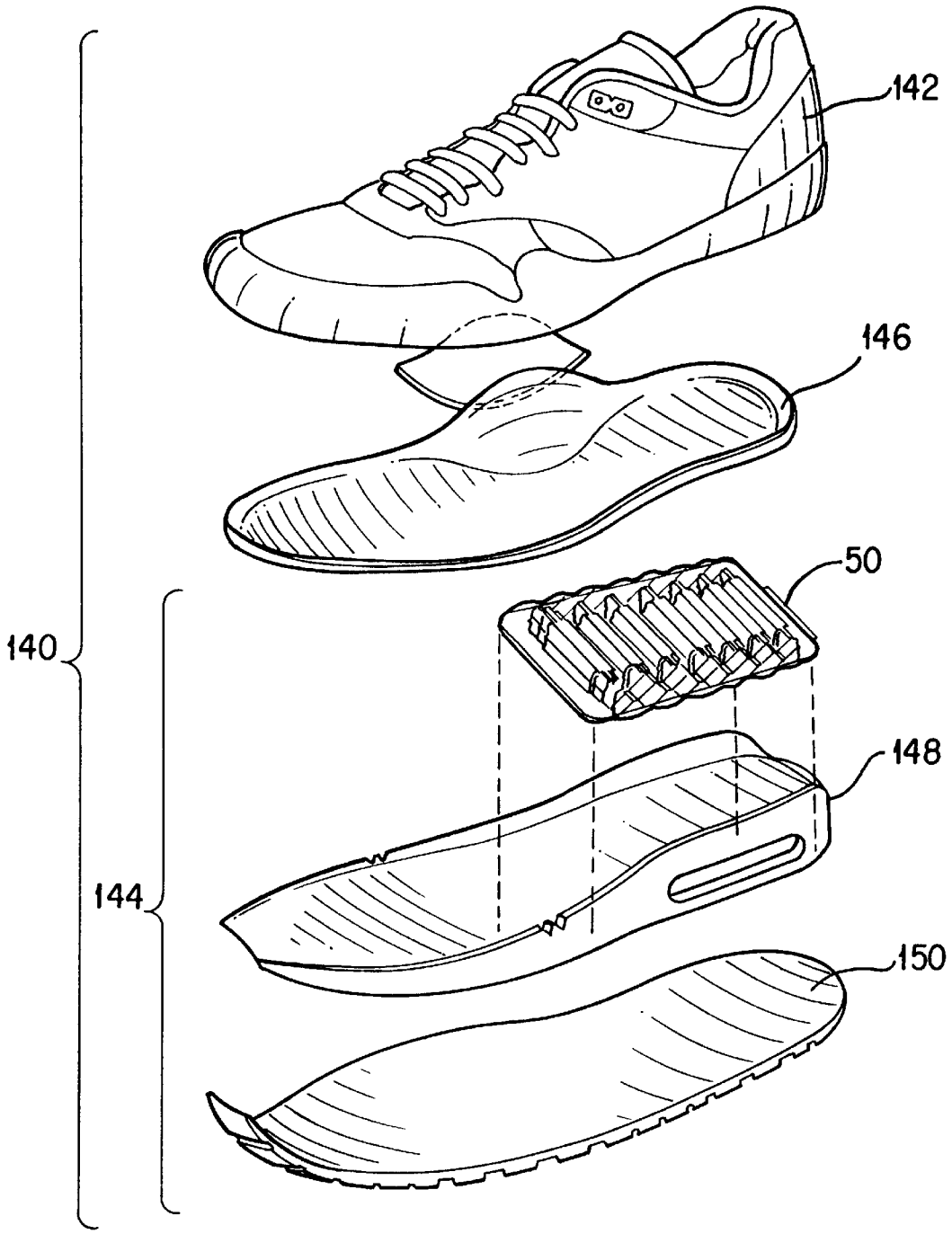
FIG. 24 is an exploded perspective view of a shoe incorporating the bladder of FIG. 8 in the sole assembly.

FIG. 24 is an exploded perspective view of a shoe incorporating tensile bladder 50. Shoe 140 is comprised of an upper 142 for covering a wearer's foot and a sole assembly 144. Sole assembly 144 comprises an insole 146 inserted into upper 142, a midsole 148 attached to the bottom of upper 142, and an outsole 150 attached to the bottom of midsole 148. Bladder 50 is preferably incorporated into the sole assembly 144 as shown diagrammatically. Bladder 50 can be incorporated into midsole 148 by any conventional technique such as foam encapsulation or placement in a cut-out portion of a foam midsole.

Other elastomeric films may be used in place of the polyurethane material of the barrier layers and the tensile elements described above. It is not essential that the tensile element material have barrier properties or be the same gauge or type of material, or share the same properties as the outer barrier layers. Although radio frequency welding is described, other bonding methods such as thermal impulse sealing, cementing, ultrasonic welding, magnetic particle sealing and the like are contemplated to be within the scope of the present invention.

Any suitable gas or combination of gases may be used to pressurize the tensile bladder. Preferred gases are disclosed in U.S. Pat. Nos. 4,340,626 and 4,936,029 to Rudy which are hereby incorporated by reference.

The tensile bladders described above are exemplary in shape and configuration. Tensile elements may be used to form separate chambers within one bladder envelope which is otherwise configured for inflation from a single inflation point. Various sizes and shapes of tensile bladders to be incorporated into footwear are contemplated to be within the scope of the invention.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely by the claims appended hereto.

We claim:

1. An article of footwear comprising:

an upper for covering at least a portion of a wearer's foot;

a sole assembly attached to said upper, said sole assembly comprising a complex-contoured tensile bladder for providing cushioning when pressurized, said bladder comprising an outer envelope including a top barrier layer and a bottom barrier layer of elastomeric film, said envelope defining a sealing periphery, a tensile element comprising a top inner sheet of elastomeric film and a bottom inner sheet of elastomeric film welded together at a plurality of selected first weld lines, said tensile element having edges and adapted to be surrounded by and disposed within said envelope such that said sealing periphery is spaced away from the edges of said tensile element, said top barrier layer of said envelope welded to said top inner sheet, and said bottom barrier layer welded to said bottom inner sheet at a plurality of selected second weld lines which are incoincident with said first weld lines such that when said bladder is pressurized said tensile element extends between said top barrier layer and said bottom barrier layer of said envelope to provide a framework and lend a complex-contoured shape to said bladder, and a fluid under pressure which places said tensile element in tension and spaces said top barrier layer and said bottom barrier layer way from one another.

2. The article of footwear of claim 1, wherein said first weld lines of said bladder are substantially parallel to one another and adjacent ones of said first weld lines define a tube therebetween.

3. The article of footwear of claim 2, wherein said second weld lines of said bladder are disposed between adjacent ones of said first weld lines such that when said bladder is pressurized each of said first weld lines is disposed between said top barrier layer and said bottom barrier layer and said second weld lines attach said top barrier layer to said top inner sheet and attach said bottom barrier layer to said bottom inner sheet.

4. The article of footwear of claim 3, wherein portions of said first weld lines of said bladder are divided into half-welds to separate portions of said tubes from one another, each separate portion of said tubes forming a standing tensile member comprised of a portion of said top inner sheet and a portion of said bottom inner sheet joined by one of said half-welds of said first weld lines such that a plurality of standing tensile members extend between said top barrier layer and said bottom barrier layer of said envelope.

5. The article of footwear of claim 4, wherein each said half-weld of said bladder forms a hinge point for a corresponding one of said standing tensile member such that when said bladder is compressed said tensile member compresses at said hinge point.

6. A complex-contoured tensile bladder for providing cushioning when pressurized, said bladder comprising:

an outer envelope including a top barrier layer and a bottom barrier layer of elastomeric film, said envelope defining a sealing periphery;

a tensile element comprising a top inner sheet of elastomeric film and a bottom inner sheet of elastomeric film welded together at a plurality of selected first weld lines, said tensile element having edges and adapted to be surrounded by and disposed within said envelope such that said sealing periphery is spaced away from the edges of said tensile element, said top barrier layer of said envelope welded to said top inner sheet, and said bottom barrier layer welded to said bottom inner sheet at a plurality of selected second weld lines which are incoincident with said first weld lines such that when said bladder is pressurized said tensile element extends between said top barrier layer and said bottom barrier layer of said envelope to provide a framework and lend a complex-contoured shape to said bladder; and a fluid under pressure which places said tensile element in tension and spaces said top barrier layer and said bottom barrier layer way form one another.

7. The complex-contoured tensile bladder of claim 6, wherein said first weld lines are substantially parallel to one another and adjacent ones of said first weld lines define a tube therebetween.

8. The complex-contoured tensile bladder of claim 7, wherein said second weld lines are disposed between adjacent ones of said first weld lines such that when said bladder is pressurized each of said first weld lines is disposed between said top barrier layer and said bottom barrier layer and said second weld lines attach said top barrier layer to said top inner sheet and attach said bottom barrier layer to said bottom inner sheet.

9. The complex-contoured tensile bladder of claim 8, wherein portions of said first weld lines are divided into half-welds to separate portions of said tubes from one another, each separate portion of said tubes forming a standing tensile member comprised of a portion of said top inner sheet and a portion of said bottom inner sheet joined by one of said half-welds of said first weld lines such that a plurality of standing tensile members extend between said top barrier layer and said bottom barrier layer of said envelope.

10. The complex-contoured tensile bladder of claim 9, wherein each said half-weld forms a hinge point for a corresponding one of said standing tensile member such that when said bladder is compressed said tensile member compresses at said hinge point.

* * * * *